US011635071B2

(12) United States Patent
Vazquez et al.

(10) Patent No.: US 11,635,071 B2
(45) Date of Patent: Apr. 25, 2023

(54) CO-AXIAL INVERTED PISTON LINEAR ACTUATOR PUMPING SYSTEM

(71) Applicant: Schaeffler Technologies AG & Co. KG, Herzogenaurach (DE)

(72) Inventors: Andre Vazquez, Fort Mill, SC (US); Craig Hooker, Indian Land, SC (US); Michael Conlin, Rock Hill, SC (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 17/152,959

(22) Filed: Jan. 20, 2021

(65) Prior Publication Data

US 2021/0222686 A1 Jul. 22, 2021

Related U.S. Application Data

(60) Provisional application No. 62/963,584, filed on Jan. 21, 2020.

(51) Int. Cl.

| | |
|---|---|
| ***F04B 41/06*** | (2006.01) |
| ***F04D 15/00*** | (2006.01) |
| ***F04B 49/08*** | (2006.01) |
| ***F04B 49/10*** | (2006.01) |
| ***F04B 23/06*** | (2006.01) |

(52) U.S. Cl.

CPC ..... *F04B 41/06* (2013.01); *F04B 23/06* (2013.01); *F04D 15/0066* (2013.01); *F04B 49/08* (2013.01); *F04B 49/106* (2013.01)

(58) Field of Classification Search

CPC ..... F04B 11/0058; F04B 17/00; F04B 17/03; F04B 41/06; F04B 49/06; F04B 49/065; F04B 53/166; F04B 1/02; F04B 9/02; F04B 19/022; F04B 39/12; F04B 23/04; F04B 23/06; F04B 49/08

See application file for complete search history.

(56) References Cited

U.S. PATENT DOCUMENTS

| | | | | |
|---|---|---|---|---|
| 3,771,918 A | | 11/1973 | Winter | |
| 4,207,806 A | * | 6/1980 | Bimond | G01F 11/021 417/63 |
| 4,666,374 A | * | 5/1987 | Nelson | F04B 11/0058 417/345 |
| 6,074,170 A | | 6/2000 | Bert et al. | |

(Continued)

FOREIGN PATENT DOCUMENTS

| | | | | |
|---|---|---|---|---|
| ES | 2438171 T3 | | 1/2014 | |
| GB | 0736664 A | * | 9/1955 | F04B 39/12 |

*Primary Examiner* — Philip E Stimpert

(57) ABSTRACT

A pumping system for fracking fluid is designed to provide nearly constant flow rate. The pumping system includes a set of linear actuator pumping units, each driven by at least one electric motor. Each pumping unit includes a hollow threaded shaft driven by the linear actuator, two hollow cylinders fixed to an interior of the hollow shaft, and hollow pistons in each of the hollow cylinders. The hollow cylinders and hollow pistons form two pumping chambers. A first pumping chamber expels fluid when the linear actuator is moving in a first direction and a second pumping chamber that expels fluid when the linear actuator is moving in an opposite direction. The speeds of the actuators are coordinated such that a total flow rate of the pumping system is substantially constant.

10 Claims, 4 Drawing Sheets

(56) References Cited

U.S. PATENT DOCUMENTS

| | | | | |
|---|---|---|---|---|
| 8,770,950 | B2 * | 7/2014 | Biester | F16K 31/12<br>417/415 |
| 8,789,601 | B2 | 7/2014 | Broussard et al. | |
| 9,103,193 | B2 | 8/2015 | Coli et al. | |
| 9,140,110 | B2 | 9/2015 | Coli et al. | |
| 9,267,588 | B2 | 2/2016 | Buvril et al. | |
| 9,562,420 | B2 | 2/2017 | Morris et al. | |
| 9,784,265 | B2 | 10/2017 | Hines et al. | |
| 2015/0314254 | A1 * | 11/2015 | Benassi | B01F 25/46<br>366/151.1 |
| 2018/0135622 | A1 * | 5/2018 | Bean | F04B 1/122 |
| 2018/0363436 | A1 | 12/2018 | Coli et al. | |
| 2020/0362838 | A1 | 11/2020 | Vazquez et al. | |

* cited by examiner

CO-AXIAL INVERTED PISTON LINEAR ACTUATOR PUMPING SYSTEM

CROSS-REFERENCE TO RELATED APPLICATIONS

This application claims priority to U.S. Provisional Application 62/963,584 filed Jan. 21, 2020, the entire disclosure of which is incorporated by reference herein.

TECHNICAL FIELD

The disclosure relates to a pumping system. More particularly, it relates to a pumping system to pump fluid at a nearly constant flow rate.

BACKGROUND

The practice of fracking has greatly increased the amount of oil and natural gas produced within the United States. Fracking involves pumping large quantities of fluid into wells. Conventionally, this is accomplished by reciprocating pumps driven by diesel engines. Due to the availability of natural gas on site, it would be preferable to use electric power from natural gas turbine driven generators.

Conventional fracking pumps utilize a crankshaft and connecting rod mechanism to convert rotational motion into axial reciprocating motion of a piston. Each cycle of the piston produces a pulse of flow, with the flow rate during each pulse being a function of the crankshaft and connecting rod geometry. Use of a large number of pistons with offset pulses allows the total flow rate to be smoothed out, but never completely constant. The variations in flow rate are called flow ripple. Flow ripple causes pressure pulses that increase failure rates of various components in the system. Also, for a given system size, such a pump has a very limited stroke distance. Therefore, many strokes per unit time are required to achieve a desired flow rate. This increases wear on valves which must open and close once per stroke.

SUMMARY

A pumping unit includes a housing, a hollow threaded shaft, a linear actuator, a first cylinder, a first hollow piston, and first inlet and outlet valves. The hollow threaded shaft is supported for translation along an axis with respect to the housing and restrained against rotation about the axis with respect to the housing. The linear actuator is configured to rotate a nut about the axis, in response to power provided to at least one motor and to translate the hollow threaded shaft along the axis, in response to rotation of the nut. The at least one motor may include a plurality of motors arranged circumferentially around the axis. The linear actuator may include the nut, a ring gear fixed to the nut, and a plurality of pinion gears, each pinion gear meshing with the ring gear and fixed to a rotor of a respective one of the plurality of motors. The first cylinder is fixed to an interior of the hollow threaded shaft to translate with the hollow threaded shaft along the axis. The first hollow piston is fixed to the housing and extends into the first cylinder such that the first cylinder, first piston, and housing define a first chamber having a first volume which varies in response to translation of the hollow threaded shaft. The first inlet valve is configured to alternately fluidly connect the first chamber to a fluid source and separate the first chamber from the fluid source. The first outlet valve is configured to alternately fluidly connect the first chamber to a fluid sink and separate the first chamber from the fluid sink. The pumping unit may also include a second cylinder, a second hollow piston, and second inlet and outlet valves. The second cylinder may be fixed to the interior of the hollow threaded shaft to translate with the hollow threaded shaft along the axis. The second hollow piston may fixed to the housing and may extend into the second cylinder such that the second cylinder, second piston, and housing define a second chamber having a second volume which varies in response to translation of the hollow threaded shaft. The second inlet valve may be configured to alternately fluidly connect the second chamber to the fluid source and separate the second chamber from the fluid source. The second outlet valve may be configured to alternately fluidly connect the second chamber to the fluid sink and separate the second chamber from the fluid sink. A sum of the first volume and the second volume may be independent of the axial position of the hollow threaded shaft. The first cylinder may be mounted within the hollow threaded shaft such that a radial gap exists between an outer wall of the cylinder and an interior wall of the hollow threaded shaft.

A pumping system includes a plurality of pumping units as described above and a controller. The controller is configured to vary a flow rate of each of the pumping units such that a total flow rate is substantially constant. The flow rate of each pumping unit may include a series of alternating increasing phases and decreasing phases. Each increasing phase may be coordinated with a decreasing phase of another of the pumping units. Similarly, each decreasing phase may be coordinated with an increasing phase of another of the pumping units. Each decreasing phase may be separated from the previous increasing phase by a constant flow phase.

DETAILED DESCRIPTION

Embodiments of the present disclosure are described herein. It should be appreciated that like drawing numbers appearing in different drawing views identify identical, or functionally similar, structural elements. Also, it is to be understood that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The terminology used herein is for the purpose of describing particular aspects only, and is not intended to limit the scope of the present disclosure. Unless defined otherwise, all technical and scientific terms used herein have the same meaning as commonly understood to one of ordinary skill in the art to which this disclosure belongs. Although any methods, devices or materials similar or equivalent to those described herein can be used in the practice or testing of the disclosure, the following example methods, devices, and materials are now described.

Figure 1:
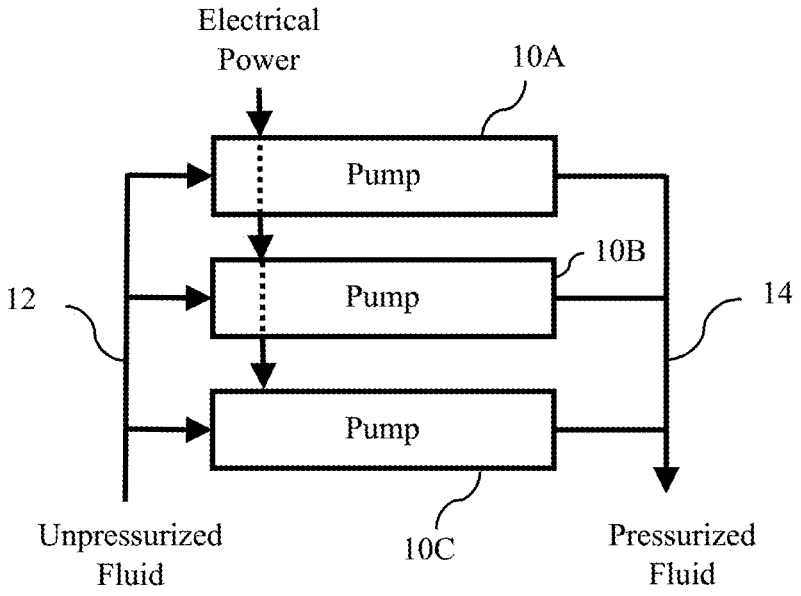
FIG. 1 is a schematic diagram of a pumping system with three pumping units.

FIG. 1 schematically illustrates an electric linear-actuator pumping system. The pumping system uses three pumping units 10A, 10B, and 10C. The number of pumping units may vary. The structure of each pumping unit is described in detail below. Each pumping unit uses electrical power to draw a fluid from a source of unpressurized fluid 12 and deliver the fluid at increased pressure to a fluid outlet 14.

Figure 2:
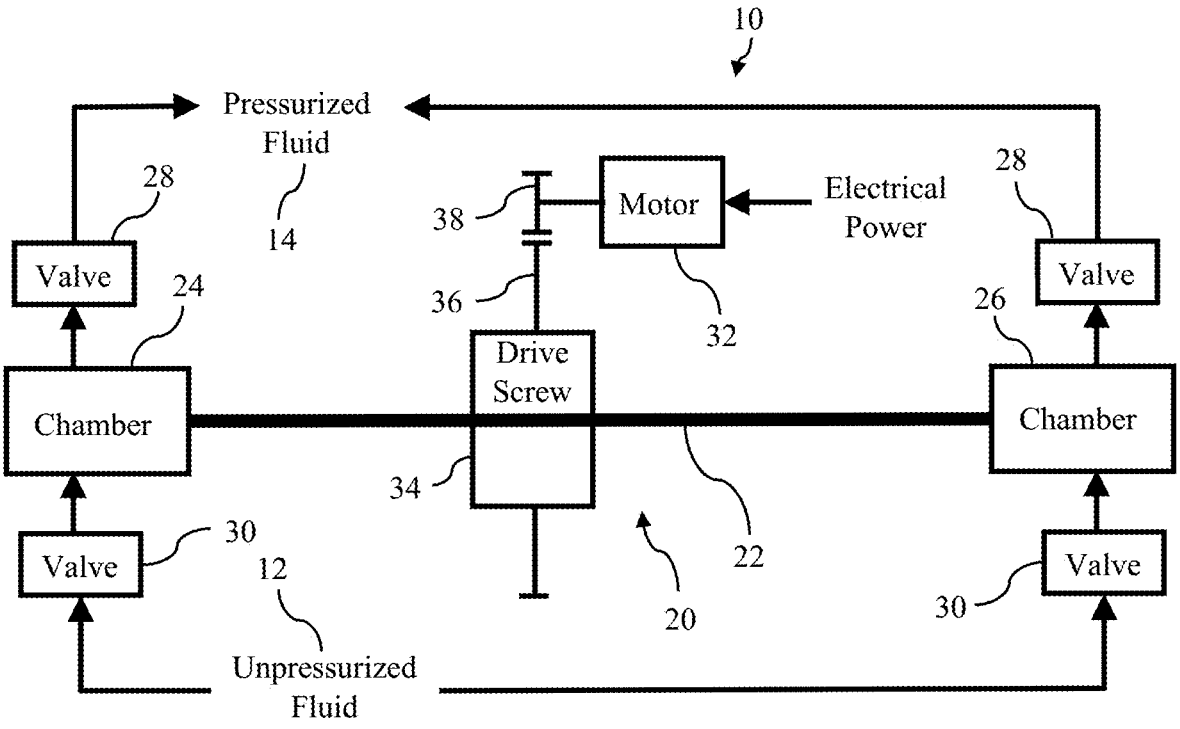
FIG. 2 is a schematic diagram of a linear actuator-based pumping unit suitable for use in the pumping system of FIG. 1.

FIG. 2 schematically illustrates the structure of each of the pumping units 10A, 10B, and 10C. Each pumping unit includes at least one electric linear actuator 20 which utilizes electrical power to translate a shaft 22. The shaft 22 may be hollow. Pumping chambers 24 and 26 have a volume that fluctuates based on the position of shaft 22. Specifically, leftward movement of shaft 22 decreases the volume of chamber 24 and increases the volume of chamber 26 by an equal amount. Chambers 24 and 26 may be formed, for example, by a cylinder/piston combination. Each pumping chamber draws fluid from the source of unpressured fluid 12 when its volume is increasing and delivers pressurized fluid to the output 14 when its volume is decreasing. Outlet valves 28 close as the volume is increasing to ensure that the fluid is drawn from source 12. Inlet valves 30 close as the volume is decreasing to ensure that the fluid is expelled to the outlet 14.

Each electric linear actuator 20 includes at least one electric motor 32 having a fixed stator and a rotatable rotor. The motors may be, for example, alternating current motors such as a permanent magnet synchronous motors. With a synchronous alternating current motor, the rotational speed of the rotor is adjusted by adjusting the frequency of the electric current using an inverter. With other types of motors, a speed or position feedback signal may be required. The motor 32 drives a nut of a planetary screw drive mechanism 34 as described, for example, in U.S. Pat. No. 9,267,588. Rotation of the nut in response to rotation of rotor 32 causes shaft 22 to displace along its axis. The nut may be fixed to a ring gear 36 which meshes with a pinion gear 38 fixed to the rotor of the electric motor.

A control unit continually monitors a control signal or multiple control signals from a sitewide controller which controls multiple pumping systems. These signals indicate a desired flow rate and pressure from the pumping system. The controller calculates a trapezoidal motion profile for each actuator unit in the local pump system, the sum of which meets the demand. The controller utilizes various types of feedback signals which may include: back-emf voltage from the motors, current supplied to the motors, linear position sensors attached to the reciprocating portion of the pumps, rotary position sensors on the integrated nuts, pressure sensors in the fluid chambers of the pumps, strain sensors on the load-bearing elements of the pumps, and condition monitoring sensors in the bearings. The controller adjusts the motion of each actuator's motors to achieve: close adherence to the commanded motion profile, even sharing of torque load on each motor within an actuator unit, and protection from damaging conditions such as cavitation, low pressure, and incomplete fillage. The controller adjusts the motion profiles of each actuator unit in the local group to achieve: even wear and maximum life of each unit, real-time compensation for flow ripple (as discussed below), and special operating conditions as instructed by sitewide controller such as: pulsation or shockwave generation, ramp up/down, and/or idle. The controller relays real-time operating parameters (position, velocity, status) to the sitewide controller.

Figure 3:
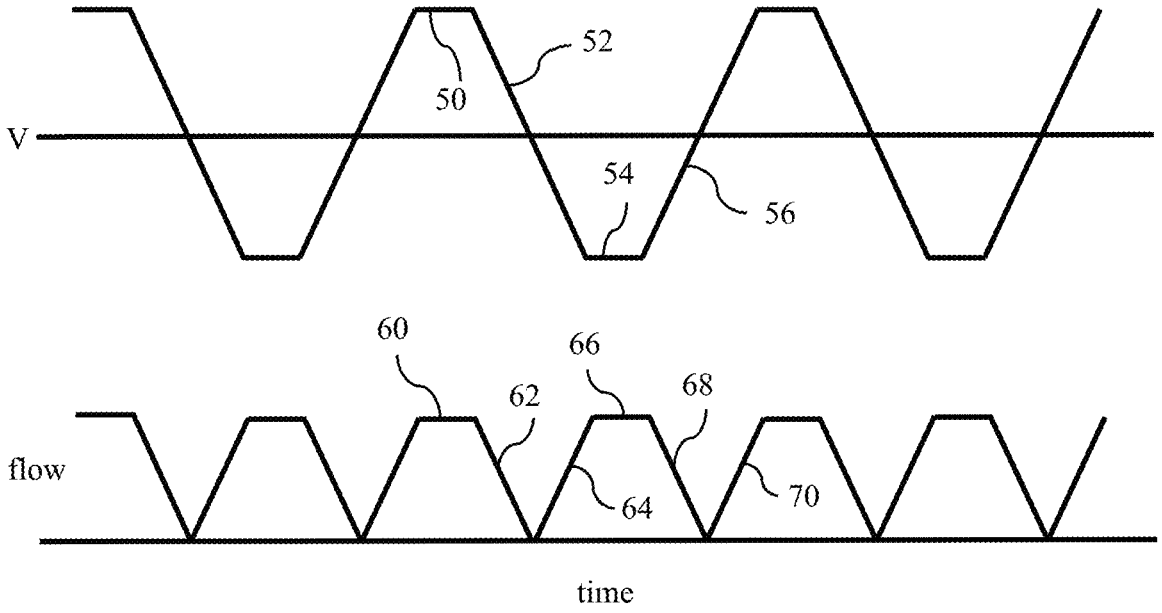
FIG. 3 is a graphical representation of the speed and flow rate of a pumping unit when operated such that the total flow for the pumping system is constant.

The top portion of FIG. 3 illustrates the velocity of shaft 22 as a function of time. During a first phase 50, the shaft moves in a positive direction at a steady speed. During a second phase 52, the shaft slows down at a steady rate. During the middle of the second phase, the shaft changes direction. During a third phase 54, the shaft moves in a negative direction at a steady speed, which is equal in magnitude to the speed of the first phase. Finally, during a fourth phase 56, the shaft accelerates at a steady rate equal to the rate of deceleration of the second phase. At the end of the fourth phase, the shaft has returned to its original position and speed and the process is repeated.

The bottom portion of FIG. 3 illustrates the fluid flow rate as a function of time. Note that the flow rate is proportional to the absolute value of the velocity. When the shaft is moving in a forward direction, flow is provided to the outlet from one of the pumping chambers. When the shaft is moving in a negative direction, flow is provided by the other pumping chamber. During the first phase 50, a constant flow rate 60 is provided by pumping chamber 26. During the first half of the second phase 52, the flow rate from pumping chamber 26 decreases to zero as shown at 62. During the second half of phase 52, the flow rate from pumping chamber 24 increases as shown at 64. During the third phase 54, a constant flow rate 66 is provided by pumping chamber 24. During the first half of the fourth phase 56, the flow rate from pumping chamber 24 decreases to zero as shown at 68. During the second half of phase 56, the flow rate from pumping chamber 26 increases as shown at 70.

With three pumping units, these phases are staggered to maintain constant total flow. At any given time, one pumping unit is operating in either phase 60 or 66, another pumping unit is operating in either phase 62 or 68, and a third pumping unit is operating in either phase 64 or 70. With three total pumping units, the length of phase 50 and 54 should be half as long as the length of phases 52 and 56. With different numbers of pumping units, the relative durations of the phases may be adjusted such that one unit is always in a declining flow phase and one unit is always in an increasing flow phase.

In addition to establishing a constant flow rate, the pumping system described above offers several advantages. Each of the pumping units has a relatively long stroke relative to its overall size. As a result, the valves do not need to open and close as often as they would for a shorter stroke pump at the same average flow rate. This improves the durability of the valves. Furthermore, the pumping system can continue to operate with one of the pumping units offline which simplifies maintenance.

Figure 4:
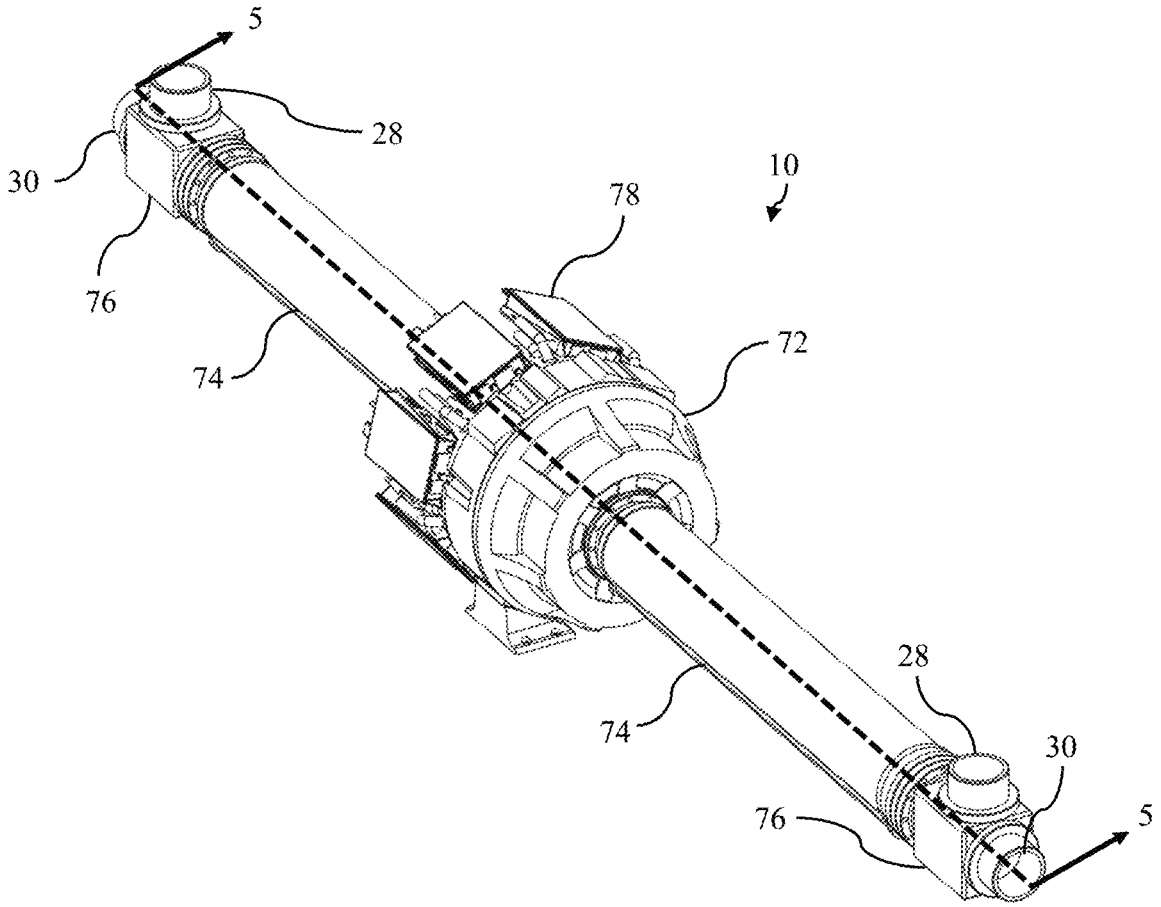
FIG. 4 is a perspective view of the linear actuator based pumping unit according to FIG. 2.

FIG. 4 shows the pumping unit 10 of FIG. 2. The pumping unit includes a multi-piece housing consisting of a central housing 72, two side housings 74, and two valve units 76. Each valve unit includes an outlet valve 28 and an inlet valve 30. A number of electric motors are supported within the central housing 72 (not visible in FIG. 4). Each electric motor is associated with a power supply unit 78 which may include an inverter to convert direct current (DC) to alternating current (AC).

Figure 5:
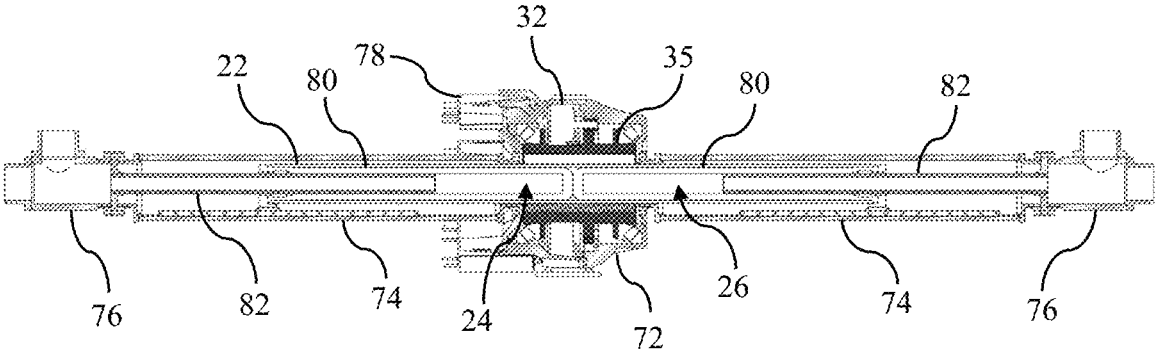
FIG. 5 is a cross-sectional view of the linear actuator based pumping unit of FIG. 4.

FIG. 5 shows a cross section of the pumping unit. In this embodiment, shaft 22 is a hollow threaded shaft, which extends from one of the side chambers 74, through the central chamber 72, and into the other side chamber 74. Two cylinders 80 are located inside hollow shaft 22 with the closed end of each cylinder near the center of the shaft and the open ends of each cylinder near the ends of the shaft. The cylinders 80 are fixed to the shaft 22. A hollow piston 82 extends from the end of each side housing 74 into a respective cylinder 80. The pistons are fixed to the housing. One end of the hollow piston 82 is open to the valve unit 76. The chambers 24 are 26 are defined by the interior surfaces of cylinders 80, the interior surfaces of hollow pistons 82, and the valve units.

Figure 6:
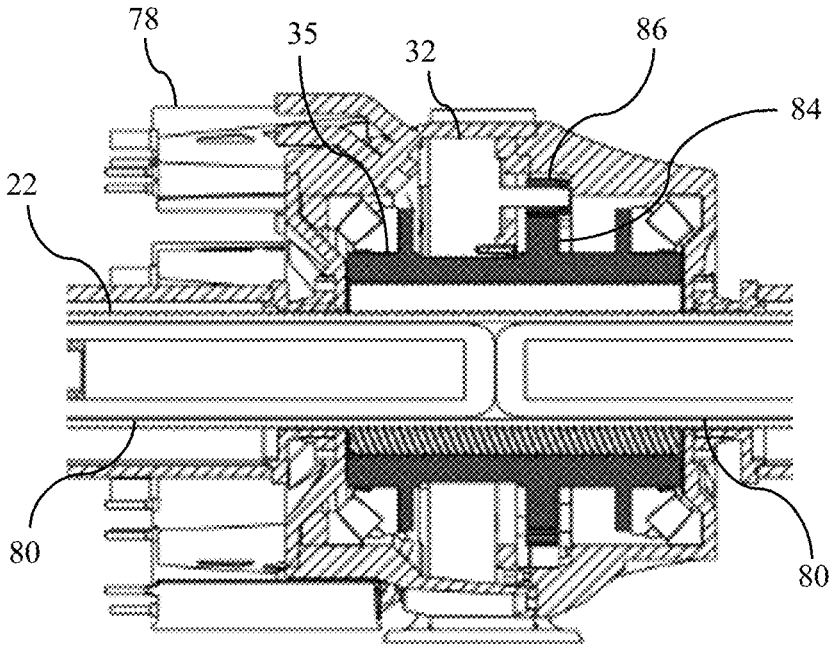
FIGS. 6 and 7 are detail cross-sectional views of the pumping unit of FIGS. 4 and 5.

FIG. 6 is a close-up view of the central housing and its contents. The nut 35 of the planetary screw drive mechanism 34 is fixed to a ring gear 84. A pinion gear 86 is fixed to the rotor of each motor 32. Each pinion gear meshes with the ring gear.

A radial gap separates the outside wall of the cylinder 80 from the interior wall of the hollow threaded shaft 22. Therefore, slight expansion of the cylinder due to pressure of the fluid therein does not alter the dimensions of the threaded shaft.

Figure 7:
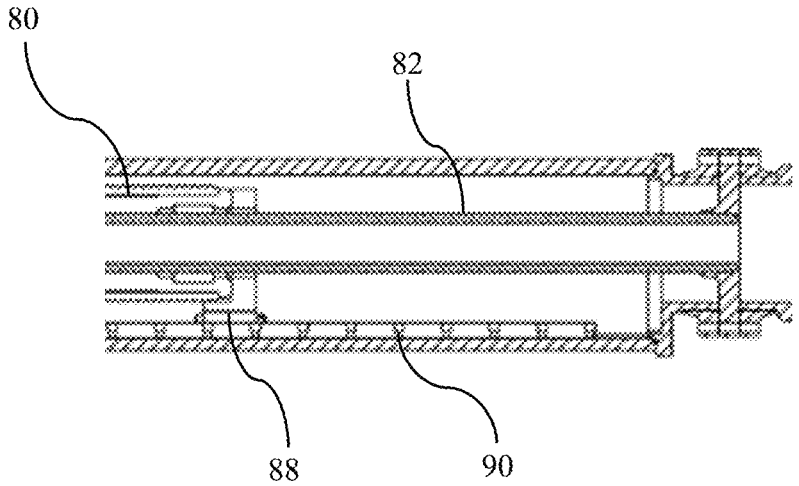

FIG. 7 is a close-up view of a portion of the side housing and its contents. The ends of shaft 22 are supported by linear support bearings 88 which travel along a linear rail 90. In addition to ensure low friction translation, this arrangement also prevents rotation of the shaft with respect to the housing.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. As such, to the extent any embodiments are described as less desirable than other embodiments or prior art implementations with respect to one or more characteristics, these embodiments are not outside the scope of the disclosure and can be desirable for particular applications.

What is claimed is:

1. A pumping unit comprising:

a housing;

a hollow threaded shaft supported for translation along an axis with respect to the housing and restrained against rotation about the axis with respect to the housing;

a linear actuator configured to rotate a nut about the axis, in response to power provided to at least one motor and to translate the hollow threaded shaft along the axis, in response to rotation of the nut;

a first cylinder fixed to an interior of the hollow threaded shaft to translate with the hollow threaded shaft along the axis;

a first hollow piston fixed to the housing and extending into the first cylinder such that the first cylinder and the first piston define a first chamber having a first volume which varies in response to translation of the hollow threaded shaft;

a first inlet valve configured to alternately fluidly connect the first chamber to a fluid source and separate the first chamber from the fluid source;

a first outlet valve configured to alternately fluidly connect the first chamber to a fluid sink and separate the first chamber from the fluid sink;

a second cylinder fixed to the interior of the hollow threaded shaft to translate with the hollow threaded shaft along the axis;

a second hollow piston fixed to the housing and extending into the second cylinder such that the second cylinder and the second piston define a second chamber having a second volume which varies in response to translation of the hollow threaded shaft;

a second inlet valve configured to alternately fluidly connect the second chamber to the fluid source and separate the second chamber from the fluid source; and a second outlet valve configured to alternately fluidly connect the second chamber to the fluid sink and separate the second chamber from the fluid sink wherein the housing defines at least a portion of the first and second chambers.

2. The pumping unit of claim 1 wherein a sum of the first volume and the second volume is independent of an axial position of the hollow threaded shaft.

3. The pumping unit of claim 1 wherein:

the at least one motor comprises a plurality of motors arranged circumferentially around the axis; and the linear actuator comprises the nut, a ring gear fixed to the nut, and a plurality of pinion gears, each pinion gear meshing with the ring gear and fixed to a rotor of a respective one of the plurality of motors.

4. The pumping unit of claim 1 wherein the first cylinder is mounted within the hollow threaded shaft such that a radial gap exists between an outer wall of the cylinder and an interior wall of the hollow threaded shaft.

5. A pumping system comprising:

a plurality of pumping units according to claim 1; and a controller configured to vary a flow rate of each of the pumping units such that a total flow rate is substantially constant.

6. The pumping system of claim 5 wherein the flow rate of each pumping unit includes a series of alternating increasing phases and decreasing phases, each increasing phase coordinated with a decreasing phase of another of the pumping units, each decreasing phase coordinated with an increasing phase of another of the pumping units.

7. The pumping system of claim 6 wherein each decreasing phase is separated from a previous increasing phase by a constant flow phase.

8. The pumping unit of claim 1, wherein the first cylinder is arranged adjacently to the second cylinder.

9. The pumping unit of claim 1, wherein the first cylinder is coaxial to the second cylinder.

10. The pumping unit of claim 1, wherein the first cylinder abuts with the second cylinder.

* * * * *